US005461405A

United States Patent [19]

Lehmann et al.

[11] Patent Number: 5,461,405

[45] Date of Patent: Oct. 24, 1995

[54] INK JET PRINTER DEVICE WITH EXCHANGEABLE PRINTHEADS

[75] Inventors: Manfred Lehmann, Puchheim; Peter Koller, München, both of Germany

[73] Assignee: Eastman Kodak Company, Rochester, N.Y.

[21] Appl. No.: 306,175

[22] Filed: Sep. 14, 1994

Related U.S. Application Data

[63] Continuation of Ser. No. 876,855, Apr. 30, 1992, abandoned.

[30] Foreign Application Priority Data

Oct. 30, 1989 [EP] European Pat. Off. ..... 89120145
Sep. 24, 1990 [WO] WIPO ..... PCT/EP90/01619

[51] Int. Cl.[6] ..... B41J 2/14; B41J 25/308

[52] U.S. Cl. ..... 347/49; 347/8; 347/50

[58] Field of Search ..... 347/8, 40, 49, 347/50; 400/175

[56] References Cited

U.S. PATENT DOCUMENTS

| | | | |
|---|---|---|---|
| 4,329,698 | 5/1982 | Smith | 346/140 R |
| 4,376,283 | 3/1983 | Bower | 346/140 R |
| 4,633,274 | 12/1986 | Matsuda | 346/140 R |
| 4,682,188 | 7/1987 | Castellano | 346/140 R |
| 4,703,332 | 10/1987 | Crotti et al. | 346/140 R |
| 4,736,213 | 4/1988 | Piatt et al. | 346/140 R |
| 4,755,836 | 7/1988 | Ta et al. | 346/140 R |
| 4,809,015 | 2/1989 | Bowling et al. | 346/140 R X |
| 4,907,018 | 3/1990 | Pinkerpell et al. | 400/175 X |
| 4,965,596 | 10/1990 | Nagoshi et al. | 346/140 R |
| 4,990,938 | 2/1991 | Brandon et al. | 346/140 R |
| 5,119,115 | 6/1992 | Buat et al. | 346/140 R |
| 5,138,344 | 8/1992 | Ujita | 346/140 R |
| 5,245,361 | 9/1993 | Kashimura et al. | 346/140 R |

FOREIGN PATENT DOCUMENTS

| | | | |
|---|---|---|---|
| 0125742B1 | 1/1984 | European Pat. Off. | B41J 3/04 |
| 0255867 | 7/1987 | European Pat. Off. | B41J 3/04 |
| 174817 | 12/1988 | European Pat. Off. | B41J 3/04 |
| 2843064 | 4/1979 | Germany | B41J 3/04 |
| 3342895 | 6/1985 | Germany | B41J 3/04 |
| 60-204342 | 10/1985 | Japan | B41J 3/04 |

OTHER PUBLICATIONS

IBM Technical Disclosure Bulletin, vol. 17, No. 9, Feb. 75, pp. 2622–2623; R. E. Pelkie e.a.: "Cassette ink jet head".

*Primary Examiner*—Peter S. Wong
*Assistant Examiner*—Eric Frahm
*Attorney, Agent, or Firm*—Horst M. Kasper

[57] ABSTRACT

The ink jet print device has a multiplicity of plug-in type printheads (12) mounted on support plates (23). The support plates can be replaced and interchanged without difficulty by an operator. To this end, the print device is divided into a lower part and the actual printheads (12) such that, when the heads (12) are plugged in, the necessary mechanical, electrical, and hydraulic connections (27, 28, 29, 31, 26, 41, 33) between the heads (12) and the lower part of the print device are all established. Guide and locking means are used to ensure that the plugged-in heads are exactly positioned and held in place. The sockets for the individual heads (12) are each of identical design so that the simple replacement concept permits any printheads to be used for color printing and graphics and for printing with different droplet sizes.

3 Claims, 4 Drawing Sheets

INK JET PRINTER DEVICE WITH EXCHANGEABLE PRINTHEADS

This is a continuation of application Ser. No. 07/876,855, filed Apr. 30, 1992, now abandoned.

CROSS-REFERENCE TO RELATED APPLICATIONS

This application is a continuation-in-part application of another international application filed under the Patent Cooperation Treaty Sep. 24, 1990, bearing Application No. PCT/EP90/01619, and listing the United States as a designated and/or elected country. The entire disclosure of this latter application, including the drawings thereof, is hereby incorporated in this application as if fully set forth herein.

BACKGROUND OF THE INVENTION

1. Field of the Invention

The present invention relates to an ink jet print device with exchangeable printheads for reproduction of single-color and/or multicolor characters and/or graphic patterns, which ink print device is movable back and forth in print line direction along a recording substrate.

2. Brief Description of the Background of the Invention Including Prior Art

A printhead construction is known from the German printed patent document DE-OS 2,843,064 for use in connection with ink jet printing devices, where a plurality of exit nozzles disposed at a high density are provided. Individual ink droplets are ejected from the ejection exit nozzles and are thrown against a recording substrate. The ejection of the droplets in such a so-called "drop on demand printhead" is performed under the influence of thermoelectric converter elements. The thermoelectric converter elements are arranged in the shape of heating registers on a substrate. The thermoelectric converter elements are individually controllable and the thermoelectric converters are coordinated to individual ink channels. An ink jet vapor bubble is generated in the respective ink jet channel upon control of a heating resistor, where the ink vapor bubble leads to an ejection of an individual ink droplet. This method, which has become known under the concept of bubble jet technology, allows the construction of an ink jet writing device having a high resolution capacity, wherein the write head can be constructed with many closely spaced nozzle openings.

Such ink printheads exhibit a limited lifetime based on wear manifestations and aging processes. Causes for possible operating disturbances, which can lead to failures of the ink jet printers, are among others also a drying up of ink or a superficial drying of the writing liquid, marked changes of the viscosity of the writing liquid or soiling or, respectively, cloggings of the nozzle region by extrinsic particles such as, for example, paper dust. A destruction of the concave ink meniscus at the nozzle end can also lead to disturbances and, in an extreme case, to an operational failure in case of ink jet printers operating under negative pressure.

In order to assure an undisturbed operation of such ink jet writing devices, it is conventional to construct the printheads for approximately a lifetime corresponding to the useful lifetime of the printer or to accept an expensive overdimensioning. A necessary exchange of printheads employed for a lifetime can usually only be performed by skilled service personnel but not by the personnel operating the writing device.

A writing apparatus is known from the German printed patent document DE-3,342,895 with an ink writing mechanism exhibiting an exchangeable writing head for the generation of different character fonts. In order to assure a safe handling during the exchange of the write head, in particular in order to avoid a contamination of the ejection nozzles and an entrance of air into the interior of the printhead, there is furnished a locking device on a slider. The locking device can be automatically coupled with a control lever disposed in the frame upon return of the slider into the rest position, where the printhead is disposed in a protected position outside of the writing region. The locking device is pivotably supported at two end positions for the decoupling and for the coupling of the printhead and of the ink container. An easy exchange of the printhead is made possible by this construction and the print operation can be continued disturbance-free at any time after such exchange.

The European printed patent document EP-0,255,867-A2 shows an ink print apparatus, which is suitable both for multicolor as well as single-color printing based on exchangeable ink jet printheads. The ink jet printhead is exchangeably mounted on the carriage based on a support structure, wherein a first kind of ink printhead is coordinated to the single-color ink printing, and wherein a second kind of ink printhead is coordinated to the multicolor ink printing. A coding matrix is disposed between the control circuit proper of the print device and the exchangeable ink jet printhead. Upon a change from one ink printhead of the one kind to an ink printhead of the second kind (multicolor), the coding matrix automatically connects the respective connections for the control arrangement. This coding matrix can be provided in this case as plug connection, wherein the individual plug contacts are connected with plug-in switches or jacks, wherein the plug-in switches or jacks close the corresponding connections upon insertion of the ink jet printhead into the support structure. In addition there is provided a sensing device. The sensing device captures the kind of ink jet printhead employed and, dependent on the kind of ink printhead employed, switches a coding matrix connecting the nozzles with the control circuit and/or actuates a display device.

An exchangeable ink jet print device formed as a cassette is known from the IBM Technical Disclosure Bulletin, Volume 17, No. 9, February, 1975, pages 2622–2623, which includes one single ink jet printhead for the printing of single color characters or patterns. The ink jet print device is in this case disposed stationary in an ink jet print apparatus, while the recording substrate to be imprinted is moved past the nozzle opening of the ink jet printhead, and wherein thereby the ink jet droplets are applied. The cassette can be connected to the lower part of the print device via a screw connection. The electrical connection and contacting or, respectively, the ink supply is thereby performed via pins and separate ink supply tubes.

The U.S. Pat. No. 4,703,332 shows an ink jet printhead, which is disposed such as to move along a recording substrate in the print apparatus, and where the ink jet printhead exhibits one single nozzle, and where the ink jet printhead operates with an electrically conductable ink. Two electrodes are furnished for the ejection of ink. One of the electrodes is in contact with ink and a counter electrode is disposed in proximity of the nozzle. An electrical voltage pulse is applied to the electrode. The electrical voltage pulse effects an evaporation of ink in proximity of the nozzle opening and, associated therewith, an ejection of an ink droplet from the nozzle. Several such ink jet printheads are furnished for the representation of color recordings and each individual head of the plurality of such ink jet printheads is disposed inside a cassette casing containing the ink jet fluid. The ink supplies have to be moved in this case together with the print apparatus carriage. A metallic blade and an electrically conductive lever serve for the contacting of the two electrodes of each head with a control device supplying the pulses, where the metallic blade and an electrically conductive lever engage into recesses of the cassette casing.

A further possibility for furnishing exchangeable ink jet printheads in a simple manner comprises to arrange the container for the ink supply immediately at the ink jet printhead, such that when such a head is exchanged, the complete unit comprising ink jet printhead and ink supply is replaced, as disclosed in European printed patent document EP-0,125,742-B1. This is associated with the advantage that upon exchange of such a throw-away unit no fluid mechanical connections have to be coupled, however, the time intervals between the individual exchange procedures are short based on the relatively small supply of writing liquid in the simultaneously moved reservoir.

SUMMARY OF THE INVENTION

1. Purposes of the Invention

It is an object of the present invention to furnish an ink jet print device of the initially recited kind, where the ink jet print device allows to produce printouts both of single color as well as of multicolor with a high resolution, and wherein the ink jet printheads of the ink jet print device can be exchanged in a simple fashion without requiring adjustment processes.

These and other objects and advantages of the present invention will become evident from the description which follows.

2. Brief Description of the Invention

The present invention provides for an ink jet print device for ink writing apparatus. A lower part of the print device supports a plurality of individual support plates of identical construction. A plurality of exchangeably disposed is disposed on corresponding ones of the individual support plates for reproduction of single-color and/or multicolor characters and/or graphic patterns. The ink jet printheads are structured to be insertable into the lower part of the print device receiving the ink jet printheads. Means for a mechanical coupling, an electrical coupling, and a fluid-mechanical coupling of the individual ink jet printheads to the lower part of the print device are furnished such that a coupling process is performed automatically during insertion of the ink jet printheads into the lower part of the print device. Means are provided for moving the ink print device back and forth in a print line direction along a recording substrate.

The support plates can be disposed parallel and neighboring to each other along a sequence running parallel to a print line direction.

Insertion positions for the individual support plates of equal configuration can be formed in the lower part of the ink jet print device.

The mechanical coupling of the ink jet printheads can be performed by guide elements and a locking device. The guide elements and the locking device can arrest and lock the ink jet printheads in an inserted state by way of latch and locking elements.

A cam can be coordinated to a manually actuatable locking lever. The locking device can comprise a hinged lever with a bolt latch, disposed on the hinged lever and also pivotable relative to the hinged lever. The bolt latch and the hinged lever can be pressed with a leaf spring and the manually actuatable locking lever with the cam into engagement notch recesses of one of the plurality of support plates.

A common cam can be disposed at one single locking lever and can be furnished for the locking of all ink jet printheads. The common cam can act on a plurality of individual leaf springs and latch and locking elements, coordinated to the plurality of ink jet printheads, such that a locking force of one of the plurality of ink jet printheads is independent of a locking force of a second one of the plurality of ink jet printheads.

Connection lugs of conductors can be pressed onto each other during a locking process for furnishing an electrical coupling of a conductor foil leading to a respective one of the plurality of individual ink jet printheads disposed on a respective one of the plurality of support plates. A flat band conductor can lead to a control system of the writing apparatus and common to the plurality of ink jet printheads. The flat band conductor can be coordinated in the contact region by centering elements to the plurality of individual ink jet printheads. Preferably a rubber elastic press-on element furnished as a print counter support, allows performance of a locking process.

A hollow wire pin made of rubber elastic material can protrude in insertion direction of the support plate beyond a contour of the support plate. The hollow wire pin ca be furnished for a fluid mechanical coupling of one of the plurality of ink jet printheads. A cap can be disposed at the lower part of the print device. The hollow wire pin can be received by the cap. Ink jet supply containers can be furnished in the lower part of the print device. The hollow wire pin can enable a flow connection to the ink jet supply containers.

A connection piece can perform the function of a bushing. The cap can be slipped onto the connection piece. A metallic ring can be pressed onto the upper side of the cap. The metallic ring can prevent possible leakages in case of a removed ink jet printhead.

Insertion positions in the lower part of the print device can receive the plurality of ink jet printheads for printing in one print color. Insertion positions in the lower part of the print device can receive ink jet printheads for an ejection of ink with different print colors or of ink formed of different droplet sizes.

A separation between the ink jet print device lower part and the ink printheads respectively is realized in a simple fashion. The ink supply containers with the respective filling level monitors, the printer carriage guide with the cycle scanning as well as the receiver for the printheads are disposed in the lower part of the ink jet print device. The advantages of such an ink jet print device are associated with a particularly low requirement constructive form, which allows also unskilled personnel operating of the writing apparatus to exchange the ink jet printheads if required. A mechanical, electrical, and fluid mechanical connection of the ink printheads with the lower part of the ink jet print device is furnished simultaneously with the plugging in of the ink jet printheads.

Since the individual printheads are disposed on separate, identical support plates and, moreover, since all plug positions for the support plates are identically structured, the ink jet printheads can be interchanged. For example, only a single ink jet printhead can be employed in an ink writing apparatus for black printing or four ink jet printheads for the colors black, cyano blue, magenta red, and yellow can be employed in an ink writing apparatus furnished for color printing. The easy interchangeability concept allows also the employment of any printheads having for example different properties.

In addition, an arrangement of different printheads for different droplet sizes, i.e. for differing line thicknesses, is possible with otherwise identical parameters.

The different plug positions in the lower part of the ink jet print device can be furnished with different printheads and shaded-off gray inks, for example, black, dark gray, medium gray, light gray. A halftone reproduction image of fine gray scale gradients or steps becomes realizable in a particularly simple way based on this setup.

The ink jet printheads are empty prior to being inserted into the lower part of the ink jet print device and they are filled with a suction pump via a conventional cleaning station and sealing station. The filling is also possible based on overpressure onto the ink jet supply container. Each printhead can be employed for a different color based on a rinsing and/or cleaning of the ink jet printheads.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figure 1:
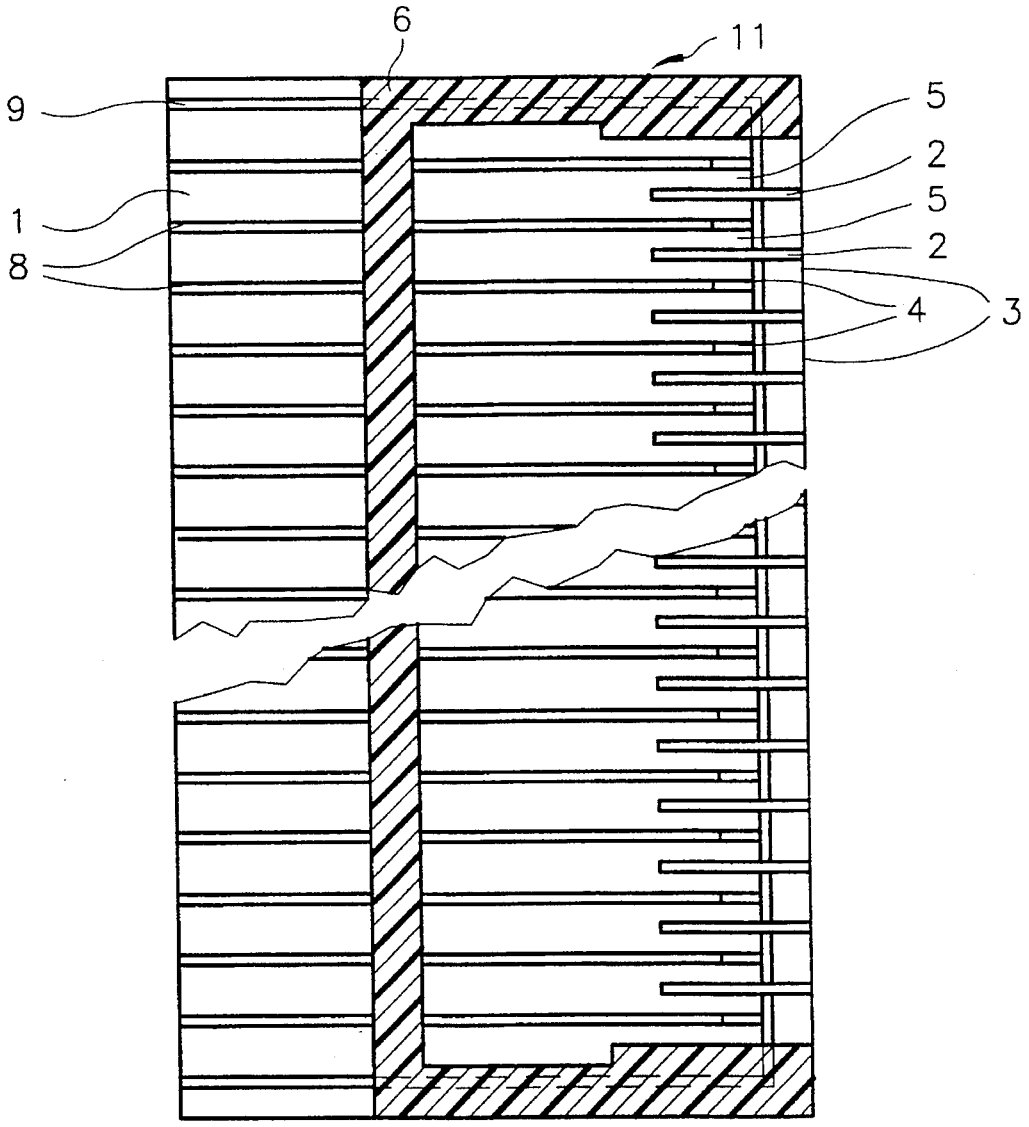
FIG. 1 is a schematic perspective top view onto a spray module in an ink writing apparatus.

According to the present invention there is provided for an ink jet print device for ink writing apparatus with several exchangeably disposed or a plurality of ink jet printheads formed by a plurality of individual support plates 23 and a plurality of spray modules 11 for reproduction of single-color and/or multicolor characters and/or graphic patterns. The ink print device is movable back and forth in print line direction along a recording substrate 20. The ink jet printheads 12 in each case comprises individual support plates 23 of identical construction. The ink jet printheads 12 are structured to be insertable into a lower part of the print device receiving the ink jet printheads 12. Means for the mechanical, the electrical, and the fluid-mechanical coupling 27, 28, 29, 31, 26, 41, 33 of the individual ink jet printheads 12 to the lower part 18 of the print device are furnished such that the coupling process is performed automatically during insertion of the ink jet printheads 12 into the lower part 18 of the print device, The support plates 23 can be disposed parallel and next to each other in print line direction.

The insertion positions for the individual support plates 23 can be formed identically in the lower part 18 of the ink jet print device.

The mechanical coupling of the ink jet printheads 12 can be performed via guide elements formed by a head guide element 34 and a mechanical guide element 35 and a locking device 28, 29, 27, 44, 31. The guide elements 34, 35 and the locking device 28, 29, 27, 44, 31 can arrest and lock the ink jet printheads 12 in an inserted state by way of latch and locking elements 29, 38, 28, 31. The locking device can comprise a hinged lever 44 with a bolt latch 29, disposed on the lever 44 and also pivotable relative to the lever 44. The bolt latch 29 and the lever 44 can be pressed with a leaf spring 27 and a manually actuatable locking lever 31 with a coordinated cam 28 into engagement notch recesses of the support plate 23.

One single locking lever 31 with a common cam 28 can be furnished for the locking of all ink jet printheads 12. The common cam 28 can act on individual leaf springs 27 and bolt latches 29, coordinated to the individual ink printheads 12, such that the locking forces of the individual ink jet printheads 12 are independent of each other.

The respective connection lugs during the locking process can be pressed onto each other for the electrical coupling of the conductor foil 32 leading to the individual ink jet printheads 12 on the support plate 23, with a flat band conductor 17 leading to the control of the writing apparatus and common to all ink jet printheads 12. The flat band conductor 17 can be coordinated in the contact region by centering elements 43 to the individual ink jet printheads 12. A rubber elastic press-on element 33 can be furnished as a print counter support for the locking process.

A hollow wire pin 24, protruding in insertion direction of the support plate beyond the contour of the support plate 23, can be furnished for a fluid mechanical coupling of the ink jet printhead 12. The hollow wire pin 24, made of rubber elastic material, can be received by a cap 26 disposed at the lower part 18 of the print device. The hollow wire pin 24 can enable the flow connection between the ink jet printheads and the ink jet supply containers 15, 16 furnished also in the lower part 18 of the print device. The cap 26 can be slipped onto a connection piece 41 performing the function of a bushing. A metallic ring 25 can be pressed onto the upper side of the cap 26. The metallic ring can prevent possible leakages in case of a removed ink jet printhead 12.

The insertion positions in the lower part 18 of the print device can receive ink jet printheads 12 for printing in one print color. The insertion positions in the lower part 18 of the print device can receive ink jet printheads 12 for the ejection of different print colors or different droplet sizes.

Figure 2:
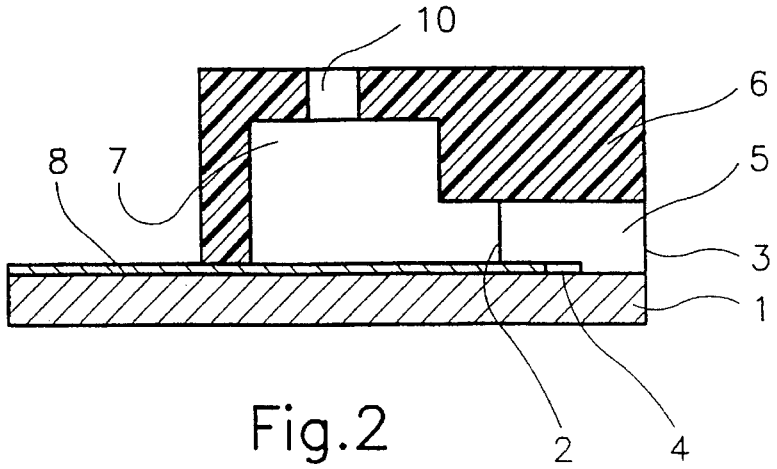
FIG. 2 is a schematic sectional side view of the spray module of FIG. 1 approximately along section line 2—2 of FIG. 1.

According to FIGS. 1 and 2, the spray module 11 comprises a substrate board 1. The ink channels 5 and the heating resistors 4 are coordinated to the ink channels are formed on the substrate board 1. The ink channels 5 can be formed for example by separating webs 2 and by the formation of a cover plate 6. The spray module 11 is thus furnished with a row of ejection openings or nozzles 3 on the side disposed toward the recording substrate. The ink channels 5 are connected with a common ink chamber 7.

The ink chamber is formed for example by a recess in the cover plate 6. The ink feeding is performed via an ink jet entry opening 10, where the ink jet entry opening 10 in the example is led through the cover plate 6. However, an ink feeding through the substrate is also possible. Each heating resistor 4 is controllable from the outside through an individual contact connector 8 and through a contact connector 9, common for all heating elements. The contact connectors 8, 9 are preferably disposed in the form of conductor paths on the substrate board 1. A jump-like temperature increase occurs upon control switching activation of a heating resistor 4 in the immediate neighborhood of this heating resistor 4. The temperature increase leads to the formation of an ink jet vapor bubble in the ink channel 5 and effects the ejection of an individual droplet of ink from the nozzle 3. After termination of a heating process, the ink jet vapor bubble collapses very rapidly, which promotes the detachment and separation of the ink jet droplet from the nozzle 3 on the one hand and which leads to a further suction of ink and thus to the refilling of the ink channel on the other hand.

Figure 3:
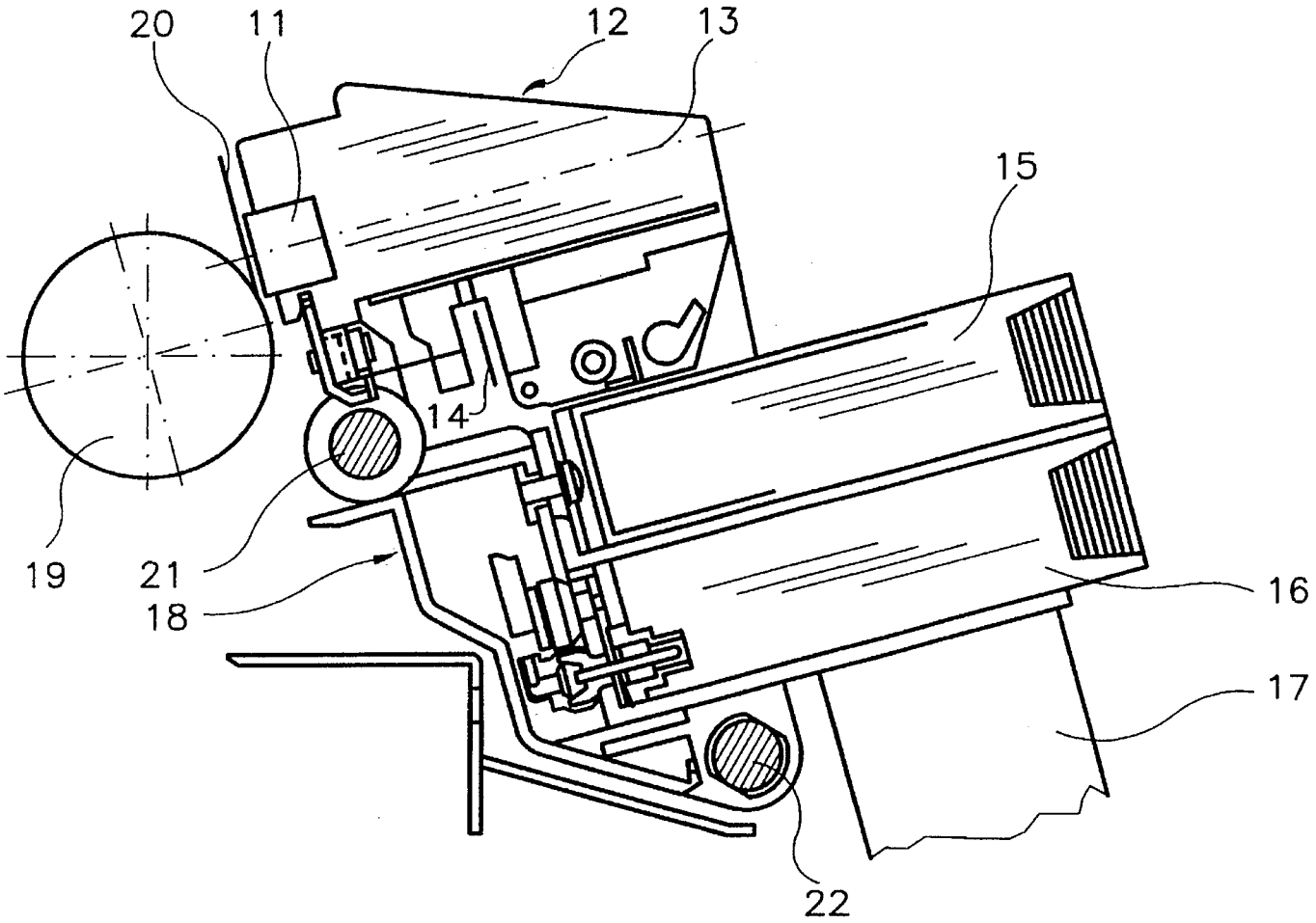
FIG. 3 is a schematic sectional side view of an ink jet printhead disposed on a print device, with a spray module according to FIGS. 1 and 2.

An ink jet print device is illustrated in FIG. 3, where a separation is realized between the lower part of the ink jet print device and the printheads proper. The ink jet printheads 12 are disposed exchangeable and parallel next to each other in print line direction on the lower part 18 of the ink jet print device. The ink jet printheads 12 described by way of FIGS. 1 and 2 contain each a spray module 11 directed in the direction of a recording substrate 20. Advantageously, four such ink jet printheads 12 for the colors yellow, magenta, cyano blue, and black are furnished. However, only one-of the printheads, i.e. the frontmost printhead, is illustrated in the representation according to FIG. 3. The axis designated with the reference numeral 13 within the printhead 12 denotes the center of the writing field, which can be imprinted with the spray module 11 during printing a full line and during performing a line passage. The recording substrate 20 is transported line by line by a print roller 19, and the recording substrate 20 serves during the writing as print counter support. The print device is movable back and forth in line direction in front of the recording substrate 20 on guide rods 21, 22 in a way not illustrated here in detail. The ink supply containers 15, 16 with a respective device surveying the filling level, the electrical connectors of which only a flat band conductor 17 is illustrated in FIG. 3, the printer carriage guide with cycle scanning 14, as well as the receiver for the ink printheads are disposed in the lower part 18 of the print device. Upon use of such an ink jet print device for producing multicolor printouts or color graphics there are provided two ink jet supply containers, where one of the ink jet supply containers is filled with the color black and the second ink jet supply container contains the three base colors: yellow, magenta red and cyano blue in three separate flasks.

One or several ink jet printheads 12 can be inserted and locked in the lower part of the print device by the user of the ink writing apparatus and can be easily exchanged.

Figure 4:
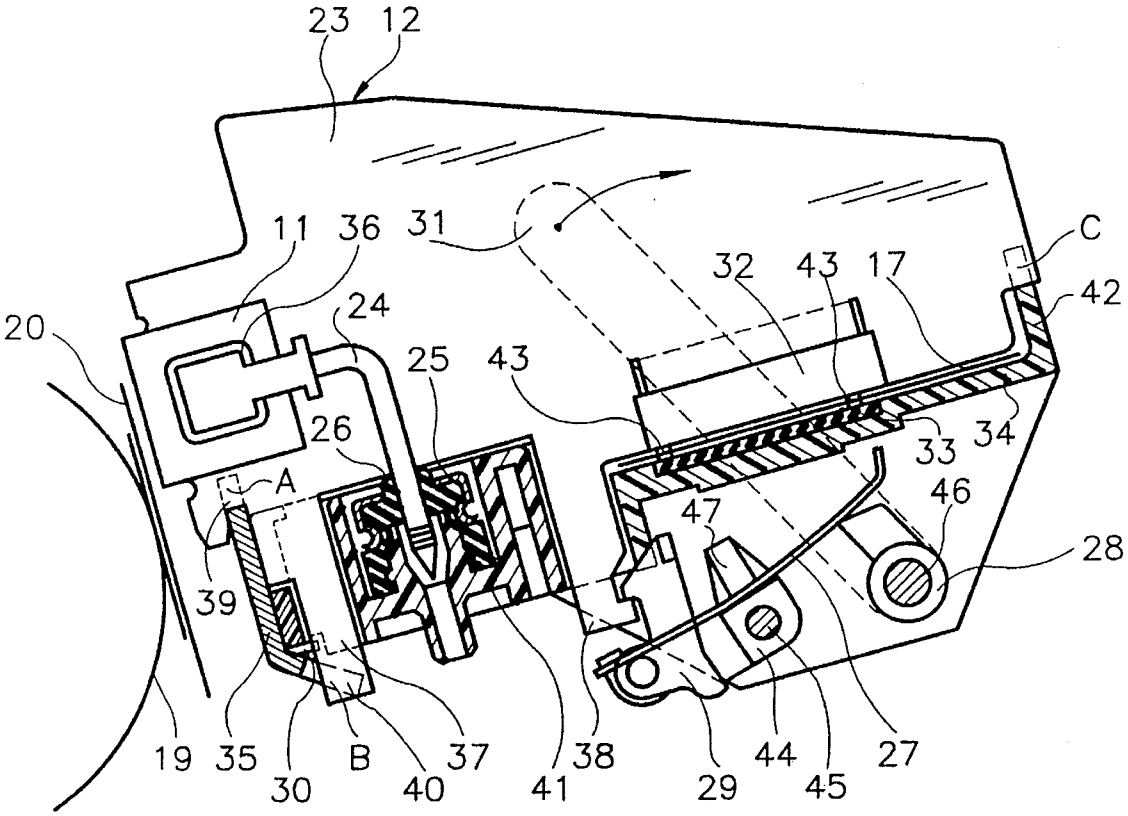
FIG. 4 is a detailed view of an upper part of FIG. 3 where an ink jet printhead is inserted and locked on a lower part of a print device.
Figure 6:
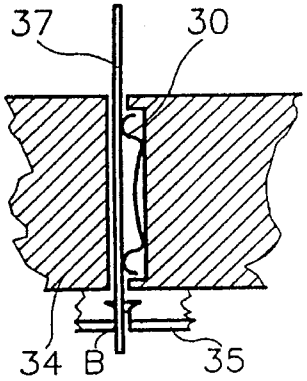
FIG. 6 is a detailed side view of the lower left part of FIG. 4.
Figure 7:
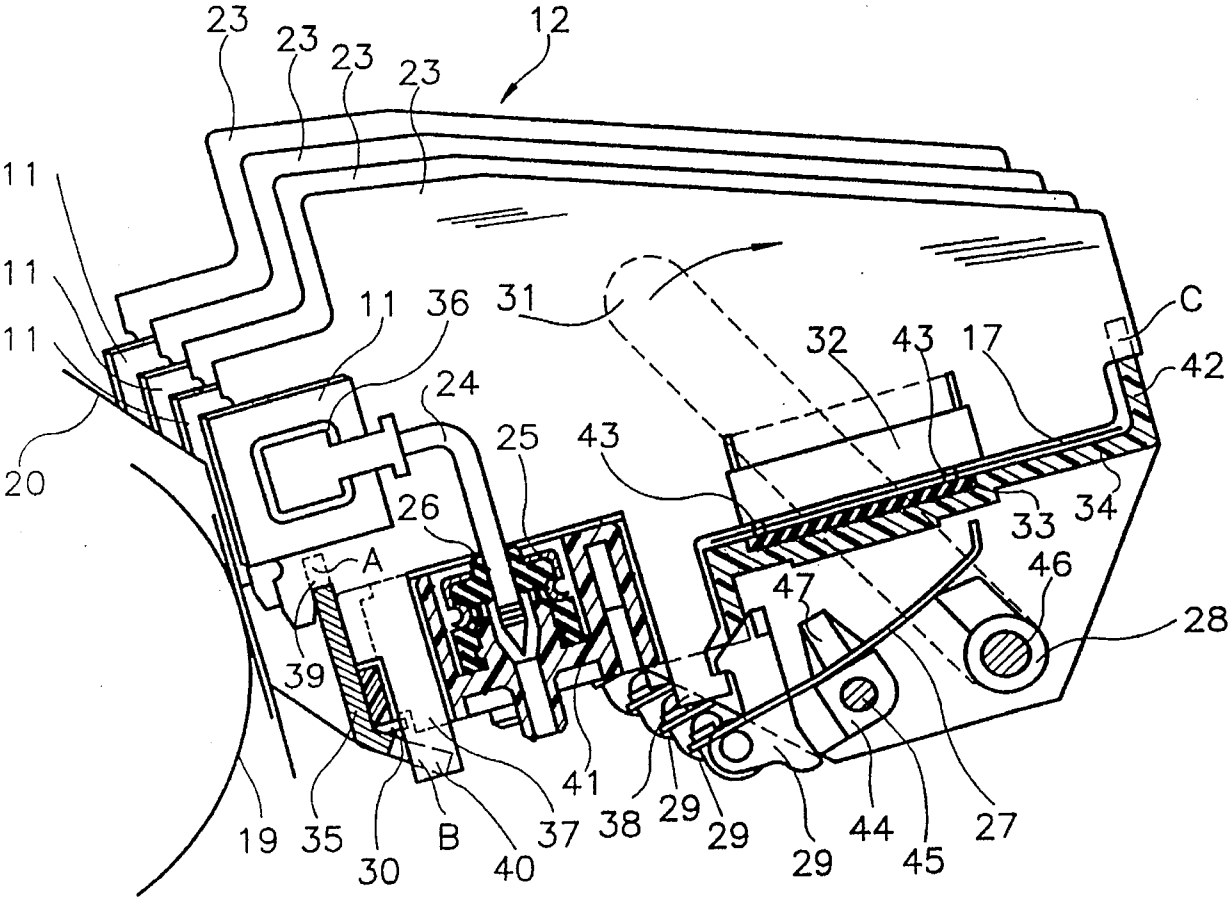
FIG. 7 is a view of a plurality of ink jet printheads.

For this purpose, a mechanical, electrical and hydraulic separation between the ink jet printhead and the lower part of the print device is realized, which is described in the following in more detail by way of FIG. 4.

This representation shows an ink jet printhead in an inserted and locked state. The exchangeable ink jet printhead 12 comprises essentially a support plate 23, produced preferably of aluminum, with a glued-on spray module 11, an ink feeding with a hollow wire pin 24 for the fluid-mechanical coupling or connection, and a printed circuit board with a conductor foil 32 or film sheet for the electrical connection. The support plate 23 is formed in this case as a pluggable unit such that guide elements and locking elements of the lower part 18 of the print device immediately come to rest with the support plate 23. For this purpose, two downwardly protruding, substantially rectangular-shaped projections 37, 38 are molded at the support plate 23. Said projections 37, 38 are inserted into the corresponding recesses of a head guide 34, realized as a plastic injection molded part, and are subsequently locked. These projections assume the coarse guidance during the insertion of the ink jet printheads. The tips of the hollow wire pins project from the lower side of the support plate 23 between the two projections 37, 38. In these regions, connection pieces 41, shaped as bushings for receiving the hollow wire pins 24, are furnished at and fixedly connected to the head guide 34. The connection pieces or bushings 41 are covered at the entry locations for the hollow wire pins 24 with a cap 26 made of a rubber elastic material, for example, an elastomer. These caps 26 are slipped onto the free end of the bushings 41 and the caps 26 surround the free end of the bushings 41 in the kind of a cap nut. Hose pieces, not illustrated in the FIG. 4, can be slid onto the opposite ends of the bushings 41, where the hose pieces lead to the ink jet supply containers. Upon insertion of the individual support plates 23, the upper side of the corresponding cap 26 is pierced by the hollow wire pin 24 belonging to the ink feeding and thereby the fluid-mechanical connection with the ink jet supply containers is achieved. A ring, 25 made of metallic material and pressed onto the individual caps 26, prevents possible leaks also in case of removed ink jet printheads and thus in case the hollow wire pins 24 are pulled out of the caps 26. The hollow wire pins 24 lead on the support plate 23 to the spray modules 11, where the hollow wire pins 24 are joining into an ink jet chamber through a cover plate made of glass. A sealing ring is designated with the reference numeral 36 in FIG. 4, where the sealing ring seals the connection location of the ink feeding to the ink chamber.

Figure 5:
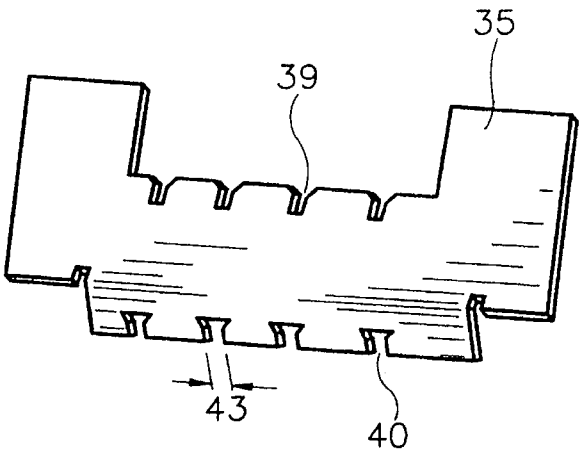
FIG. 5 is a perspective detail view onto an attachment part of the print device shown in the lower part of FIG. 3.

The lower part 18 of the print device exhibits a comb-like guide element 35 (FIG. 5) for guiding and supporting the support plates 23 at the front face directed toward the recording substrate in addition to the head guide 34. Receiving slots 39, 40 with funnel-shaped insertion bevels are furnished at the upper edge of this comb part and at the lower end, bent at obtuse angles against the ejection direction of the spray module. The comb part is preferably realized as a stamped and bent metal part. A receiving slot at the upper end and at the lower end of the comb part serves for guiding a support plate 23 in each case. A comb part for a print device with four pairs of receiver slots, i.e. for ink jet printheads on four individual support plates, is illustrated in FIG. 5. The head guide 34 exhibits at its end remote to the printing an upwardly pulled wall 42, where receiver slots, corresponding to the receiver slots in the comb part 35, are also formed at the upper edge of the wall 42, not visible in the sectional view according to FIG. 4. The width 43 of the receiver slots 39, 40 is adapted in this case to the thickness of the support plates 23, present in the corresponding insertion region, and is identical for all receiver slots such that the individual support plates and thus the individual printheads can be interchanged within the existing plug positions.

In addition, the parts for the electrical connection as well as for the locking of the ink jet printheads are disposed in the head guide 34. The electrical connection of the thermoelectric converters of the spray module 11 is performed via a conductor foil 32, disposed and running on the support plate 23, and is contacted upon insertion and locking of the ink jet printheads with a connection line 17, leading to the central control of the writing device and common to all ink jet printheads. For this purpose, the conductor foil 32 exhibits raised contact pads in the connection region where the contact pads are pressed onto corresponding contact positions of the connection line 17. A strip 33, made of a rubber elastic material, for example of elastomer, is embedded as a counter support at the connection position in the head guide 34. This elastomeric press-on element 33 assures the required contact safety in connection with the contact pads disposed raised on the conductor foil. Centering pins 43 in the head guide 34 allow a position-precise coordination of the connection line 17 to the individual ink jet printheads 12.

A bolt latch 29 serves for the mechanical locking of the ink jet printheads 12, inserted into the head guide 34 and into the comb-like guide element 35. The bolt latch 29 can lock into a notch recess, not designated in detail, in the projection 38 of the carrier plate 23. The bolt latch 29 is disposed pivotably on a lever 44, supported on one side on the lower part 18 of the print device with an axle 45. The end of a leaf spring 27 is clamped in the bolt latch 29 above the rotation point of the bolt latch 29. The free end of the leaf spring 27 leads via the lever 44 in the direction toward a locking lever 31, disposed on the side of the print device. The locking lever 31 is pivotably supported on an axle 46 at the lower part 18 of the print device. A cam 28, solidly connected to the footpoint or lower point of this locking lever 31 and common to all ink jet printheads, is formed at the footpoint of this locking lever 31. The leaf springs 27 rest on the ink jet printheads. A nose-shaped protrusion 47 is furnished at the lever 44 supporting the bolt latch 29. The nose-shaped protrusion 47 assures that the leaf spring 27 does not escape upwardly upon locking of the ink jet printheads and that the pivoting motion of the locking lever 31 is reliably transferred via the leaf spring 27 onto the bolt latch 29. In each case, a bolt latch 29 is furnished for each insertable ink printhead. The bolt latch is pressed via a respective leaf spring 27 into the notch recess of the first projection 38. It is thereby achieved that the locking forces of the individual ink jet printheads are independent from each other despite one single locking lever with a common cam for all ink jet printheads. Upon insertion and plugging-in of a support plate 23, the projections 37 and 38, protruding from the support plate 23 in the insertion direction, press and reach into the corresponding receivers of the head guide 34 and assume a coarse pre-guidance. The hollow of the plurality of wire pins of the ink supply system pierces the elastic cap of the plurality of elastic caps 26 already during this coarse guidance. The elastic cap tolerates a possibly occurring center mismatch and reliably seals in each case the connection position based on the above described structure of the elastic cap 26. The insertion bevels both at the head guide 34 as well as at the comb 35 facilitate the transition from the coarse guidance into the precise coordination of the support plates to the lower part of the ink jet print system and thus also the position of the ink jet printheads. The comb with its finely and precisely stamped receiver slots 39, 40 assumes the guidance toward the end of the insertion stroke and positions the support plates in a precise position. The support plate 23 comes to rest in the inserted state at the positions designated with the reference characters A, B, C. In each case a leaf spring 30 is furnished for each ink jet printhead 12 in the region of the second projection 37 between the rest positions A and B in order to eliminate the interfering air of a fitting space in the attachment region of the comb 35. This leaf spring balances and compensates the occurring play in a direction perpendicular to the drawing plane and is structured such that the leaf spring presses laterally against the support plate 23 only at the end of the insertion process such that the thereby generated lateral force does not have to be overcome already during the complete insertion process. The locking lever 31 is swivelled in a clockwise direction for the locking of the inserted support plate. The common cam 28 is thereby rotated in the same sense of rotation and clamps the leaf spring 27. Since this leaf spring is solidly clamped both at the lever 44 as well as at the bolt latch 29, and since the lever 44 is rotatably supported on the lower part 18 of the print system, the bolt latch 29, disposed at this lever, is pressed with its nose-shaped protrusion into the notch recess of the projection 38. The contour of the cam is thereby matched such to the leaf spring, that a dead point engagement occurs, i.e. that the support plates are locked and secured via friction forces.

It will be understood that each of the elements described above, or two or more together, may also find a useful application in other types of print devices differing from the types described above.

While the invention has been illustrated and described as embodied in the context of an ink jet print device with exchangeable print heads, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. An ink jet print device for an ink writing apparatus comprising:

a plurality of individual support plates of identical construction;

a lower part of the ink jet print device supporting the plurality of individual support plates;

a plurality of spray modules, wherein the plurality of spray modules together with the plurality of individual support plates define a plurality of ink jet printheads;

a mechanical guide element having means for accepting the plurality of ink jet printheads and for determining positions of each one of the plurality of ink jet printheads, wherein each one of the plurality of spray modules is disposed on a corresponding one of the plurality of individual support plates for reproduction of single-color and/or multicolor characters and/or graphic patterns, and wherein the plurality of ink jet printheads is structured to be exchangeably insertable into the lower part of the ink jet print device and exchangeably insertable into the mechanical guide element;

means for a mechanical coupling, an electrical coupling, and a fluid-mechanical coupling of said each one of the plurality of ink jet printheads to the lower part of the ink jet print device furnished such that a coupling process is performed automatically during insertion of the plurality of ink jet printheads into the lower part of the ink jet print device; and means for moving the ink jet print device back and forth in a print line direction along a recording substrate;

a spray module of the plurality of spray modules is attached to a support plate of the plurality of individual support plates and wherein the spray module includes a substrate board, wherein the spray module comprises ink channels formed on the substrate board, and wherein the ink jet print device further comprises: heating resistors formed on the substrate board and associated with the ink channels, wherein the ink channels are formed by separating webs;

a cover plate furnished at the spray module such that the spray module is furnished with a row of ejection nozzles on a side disposed toward the recording substrate;

a common ink chamber provided in the spray module, wherein the ink channels are connected to the common ink chamber, wherein the common ink chamber is formed by a recess in the cover plate;

an ink jet entry opening led through the cover plate for feeding ink through the ink jet entry opening;

a common contact connector connected to and common to the heating resistors; and individual contact connectors connected to individual ones of the heating resistors for individually controlling the heating resistors, wherein the contact connectors are disposed in a form of conductor paths on the substrate board such that a jump-like temperature increase occurs upon control switching activation of one of the heating resistors in an immediate neighborhood of said one of the heating resistors, and wherein the temperature increase leads to a formation of an ink jet vapor bubble in the ink channels and effects an ejection of an individual droplet of ink from a nozzle.

2. An ink jet print device for an ink writing apparatus comprising:

a plurality of individual support plates of identical construction;

a lower part of the ink jet print device supporting the plurality of individual support plates;

a plurality of spray modules, wherein the plurality of spray modules together with the plurality of individual support plates define a plurality of ink jet printheads;

a mechanical guide element formed as a comb-like guide element for guiding and supporting the plurality of individual support plates, wherein each of the plurality of spray modules is disposed on corresponding ones of the plurality of individual support plates for reproduction of single-color and/or multicolor characters and/or graphic patterns, and wherein each one of the plurality of ink jet printheads is constructed to be exchangeably insertable into the lower part of the ink jet print device receiving the plurality of ink jet printheads and into the mechanical guide element;

means for a mechanical coupling, an electrical coupling, and a fluid-mechanical coupling of said each one of the plurality of ink jet printheads to the lower part of the ink jet print device furnished such that a coupling process is performed automatically during insertion of the plurality of ink jet printheads into the lower part of the ink jet print device;

means for moving the ink jet print device back and forth in a print line direction along a recording substrate;

a print head guide having recesses and receiver slots and an upwardly pulled wall at an end remote relative to a printing area, wherein a width of the receiver slots matches a thickness of each support plate of the plurality of individual support plates present in a corresponding insertion region;

two downwardly protruding, rectangular-shaped projections molded at said each one of the plurality of individual support plates, wherein said downwardly protruding, substantially rectangular-shaped projections are inserted into the recesses of the print head guide;

an ink feeding connector having a plurality of hollow wire pins for the fluid-mechanical coupling, wherein a tip of each hollow wire pin of the plurality of hollow wire pins projects from a lower side of said each one of the plurality of individual support plates between the two downwardly protruding, rectangular-shaped projections;

a printed circuit board with a conductor foil for furnishing the electrical coupling;

a plurality of connection pieces shaped as bushings fixedly connected to the print head guide for receiving the plurality of hollow wire pins;

a plurality of caps made of a rubber elastic material, wherein one cap of the plurality of caps surrounds each free end of one connection piece of the plurality of connection pieces and wherein an upper side of a corresponding cap is pierced by only one hollow wire pin of the plurality of hollow wire pins belonging to the ink feeding connector;

a sealing ring placed on each cap for sealing a connection location of the ink feeding to the ink jet chamber;

a conductor foil disposed on said each one of the plurality of individual support plates, wherein an electrical connection of thermoelectric converters of the each one of the plurality of spray modules is furnished through the conductor foil, and wherein the conductor foil is contacted upon insertion and locking of the plurality of ink jet printheads with a connection line leading to a central control of the ink writing apparatus and to the plurality of ink jet printheads, and wherein the conductor foil includes raised contact pads in a connection region, wherein the contact pads are pressed onto corresponding contact positions of the connection line;

a strip made of a rubber elastic material embedded as a counter support at a connection position in said print head guide for assuring a required contact safety in connection with the contact pads disposed raised on the conductor foil; and centering pins disposed in said print head guide allowing a position-precise coordination of the connection line to said each one of the plurality of ink jet printheads.

3. An ink jet print device for an ink writing apparatus comprising:

a plurality of individual support plates of identical construction;

a lower part of the ink jet print device having a print head guide and supporting the plurality of individual support plates;

a plurality of spray modules, wherein the plurality of spray modules together with the plurality of individual support plates define a plurality of ink jet printheads;

a mechanical guide element having means for accepting the plurality of ink jet printheads and for determining positions of the plurality of ink jet printheads, wherein each of the plurality of spray modules is disposed on corresponding ones of the plurality of individual support plates for reproduction of single-color and/or multicolor characters and/or graphic patterns, and wherein each one of the plurality of ink jet printheads is constructed to be exchangeably insertable into the lower part of the ink jet print device receiving the plurality of ink jet printheads and exchangeably insertable into the mechanical guide element;

means for a mechanical coupling, an electrical coupling, and a fluid-mechanical coupling of said each one of the plurality of ink jet printheads to the lower part of the ink jet print device furnished such that a coupling process is performed automatically during insertion of the plurality of ink jet printheads into the lower part of the ink jet print device;

means for moving the ink jet print device back and forth in a print line direction along a recording substrate;

a lever coordinated to said each one of the plurality of printheads and attached to the lower part;

a bolt latch coordinated to said each one of the plurality of printheads serving for furnishing a mechanical locking of said each one of the plurality of ink jet printheads inserted into the print head guide, wherein the bolt latch locks into a notch recess in a first projection of a support plate of the plurality of individual support plates, and wherein the bolt latch is pivotably disposed on the lever one-sidedly supported at the lower part of the ink jet print device with a common cam;

a locking lever disposed on a side of the ink jet print device;

a first leaf spring coordinated to said each one of the plurality of printheads for achieving locking forces of said each one of the plurality of ink jet printheads independent from each other despite one single locking lever;

a nose-shaped protrusion furnished at the lever supporting the bolt latch for assuring that the first leaf spring does not escape upwardly upon locking of said each one of the plurality of ink jet printheads and that a pivoting motion of the locking lever is reliably transferred through the first leaf spring onto the bolt latch, wherein the first projection and a second projection, protruding from the support plate of the plurality of individual support plates in an insertion direction, press and reach into corresponding receivers of the print head guide; and a second leaf spring furnished for said each one of the plurality of ink jet printheads in a region of the second projection between a first rest position and a second rest position in order to eliminate an interfering air gap of a fitting space in an attachment region of the mechanical guide element.

* * * * *

UNITED STATES PATENT AND TRADEMARK OFFICE

CERTIFICATE OF CORRECTION

PATENT NO. : 5,461,405
DATED : October 24, 1995
INVENTOR(S) : Manfred Lehmann and Peter Koller It is certified that error appears in the above-indentified patent and that said Letters Patent is hereby corrected as shown below:

On the title page, item [54] and column 1, line 1, change "PRINTER" to --PRINT--.

Signed and Sealed this

First Day of October, 1996

*Attest:*

Bruce Lehman

BRUCE LEHMAN

*Attesting Officer*

*Commissioner of Patents and Trademarks*